US007191555B2

(12) United States Patent
Hughes

(10) Patent No.: US 7,191,555 B2
(45) Date of Patent: Mar. 20, 2007

(54) DISPLAY PANELS

(76) Inventor: Robert P. Hughes, 5610 Wisconsin Ave., #1104, Chevy Chase, MD (US) 20815

( * ) Notice: Subject to any disclaimer, the term of this patent is extended or adjusted under 35 U.S.C. 154(b) by 0 days.

(21) Appl. No.: 10/372,237

(22) Filed: Feb. 25, 2003

(65) Prior Publication Data

US 2004/0163293 A1 Aug. 26, 2004

(51) Int. Cl.
*G09F 17/00* (2006.01)

(52) U.S. Cl. ..... 40/603; 40/610; 38/102.91; 160/368.1

(58) Field of Classification Search ..... 40/603, 40/604, 610, 611.01, 605, 645; 38/102.1, 38/102.91; 160/329, 354, 368.1
See application file for complete search history.

(56) References Cited

U.S. PATENT DOCUMENTS

| | | | | |
|---|---|---|---|---|
| 2,163,359 | A * | 6/1939 | Van Derveer | 160/378 |
| 3,477,158 | A * | 11/1969 | Chandos | 40/617 |
| 3,589,048 | A | 6/1971 | Mollet et al. | |
| 4,265,039 | A | 5/1981 | Brooks | |
| 4,372,071 | A | 2/1983 | Vicino | |
| 4,569,143 | A * | 2/1986 | Bannister | 40/603 |
| 4,574,506 | A | 3/1986 | Morgan | |
| 4,773,174 | A * | 9/1988 | Boeniger et al. | 40/792 |
| 4,776,121 | A * | 10/1988 | Vicino | 40/610 |
| 4,817,319 | A | 4/1989 | Vitale | |
| 4,875,302 | A | 10/1989 | Noffsinger | |
| 4,986,016 | A | 1/1991 | Wichman | |
| 5,046,274 | A * | 9/1991 | David | 40/604 |
| 5,125,205 | A | 6/1992 | Wichman | |
| 5,347,737 | A | 9/1994 | Theobald, III | |
| 5,632,390 | A | 5/1997 | Podergois | |
| 5,664,354 | A | 9/1997 | Daviau et al. | |
| 5,839,705 | A | 11/1998 | LaMotte | |
| 5,983,545 | A | 11/1999 | Marco | |
| 6,012,688 | A | 1/2000 | LaMotte | |
| 6,192,635 | B1 | 2/2001 | Zheng | |
| 6,240,666 | B1 * | 6/2001 | Apel et al. | 40/610 |
| 6,332,284 | B1 * | 12/2001 | Tafforeau | 40/603 |
| 6,363,644 | B1 * | 4/2002 | Frost | 40/607.03 |
| 6,454,227 | B1 * | 9/2002 | LaMotte | 248/165 |
| 6,495,238 | B1 * | 12/2002 | Campbell | 428/121 |
| D468,362 | S | 1/2003 | Zarelius | |
| 6,571,496 | B2 | 6/2003 | Zarelius | |
| 6,588,133 | B1 * | 7/2003 | Garrity | 40/591 |
| 6,981,350 | B1 * | 1/2006 | Redmon | 52/646 |
| 7,020,993 | B2 * | 4/2006 | Pritchard | 40/610 |

FOREIGN PATENT DOCUMENTS

| | | |
|---|---|---|
| EP | 0229636 | 8/1987 |
| EP | 0344237 | 9/1991 |
| EP | 0570562 | 8/1992 |
| EP | 0527478 | 12/1992 |
| EP | 0890940 | 7/1998 |
| WO | 8301140 | 3/1983 |
| WO | 8902495 | 3/1989 |
| WO | 0073063 | 7/2000 |

* cited by examiner

OTHER PUBLICATIONS

Judith Vandsburger, "Making it BIG at the XIX Winter Olympiad", www.signidustry.com/banners/05-31-02-NurOlympics.php3 printed Feb. 14, 2003.

*Primary Examiner*—Gary C. Hoge
(74) *Attorney, Agent, or Firm*—Mathew A. Pequignot; Hall Vande Sande & Pequignot

(57) ABSTRACT

Display panels made at least partially of stretch fabric are disclosed. Different ways of mounting these display panels onto supporting structures such as folding frames are disclosed. The display panels can be used indoors and outdoors. The versatility of the display panels makes them an excellent display media for trade shows and temporary exhibitions.

20 Claims, 13 Drawing Sheets

DISPLAY PANELS

TECHNICAL FIELD

The present invention relates to displays, in particular display panels made at least partially of stretch fabric. In preferred embodiments, these display panels are adapted to be mounted on supporting structures.

BACKGROUND OF THE INVENTION

Display panels are commonly used to advertise products and services. Generally it is important that such panels are attractive and eye-catching. When those display panels are used for limited periods of times, e.g., at trade shows, it is often equally important that they are easy to transport, quick to set up and ready to use.

Accordingly, major efforts have gone into designing support structures for display panels that are lightweight and can be assembled and disassembled fairly quickly. Popular are, in particular, foldable, lightweight structures that can be compacted and thus are easy to transport.

Stretch fabrics have been known and used for many years. Early applications included uses in the theater industry such as for costumes and stage decorations. More recently, stretch fabrics have also been used for indoor and outdoor advertisement.

However, the advantages of stretch fabrics have not been fully realized for the sign and display industry. Indeed, it is believed that there is a long felt, unsatisfied need for display panels that are at least partially made of stretch fabric and that can be easily mounted to and dismounted from a supporting structure. The present invention is aimed at meeting these unfulfilled needs.

SUMMARY OF THE INVENTION

The invention relates to display(s) comprising at least one display panel comprising portions of the panel at its outer edges which are composed of single layer stretch fabric. The stretch fabric has at least one aperture in the single layer portions of the panel for mounting the panel on at least one supporting structure. The aperture can pass through one surface of the panel to another surface of the panel. The display panel may be attachable to the supporting structure without breaking connections between portions of the supporting structure. The aperture can be a buttonhole. The buttonhole(s) can have stitched reinforcement at the edges. The longitudinal axis of a buttonhole can divide the corners of a display panel into two substantially equal sections. The display panel can have at least two pairs of diagonally opposed elongated buttonholes, a first axis that is defined by an imaginary reference line passing through a first pair of buttonholes and a central portion of the panel and a second axis defined by a second imaginary reference line passing through a second pair of buttonholes and the central portion of the panel. The first and second buttonhole pairs respectively can be elongated more nearly parallel than perpendicular to the first and second axes. The first and second button hole pairs respectively can be substantially parallel to the first and second axes. The display panel can have a third axis which is defined by an imaginary reference line extending along a side of the display panel. The panel can have at least one side button hole positioned along a side of the panel. This side button hole can be more nearly parallel than perpendicular to the third axis.

The base portion of the display panel can be made substantially of single layer stretch fabric. This stretch fabric can weigh less than 10 ounces per square yard. The display panel can be substantially cornerless. The display panel can be adapted to be mounted on a folding supporting structure and can be adapted to stay attached to the folding supporting structure when it is folded.

The invention also relates to a method for producing a display comprising providing at least one panel that at portions of its outer edges is composed of single layer stretch fabric, and generating at least one aperture in the single layer portions of the panel, wherein the aperture is adapted to mount the panel onto a supporting structure.

The invention also relates to display(s) comprising at least one display panel made at least in part of stretch polyester fabric comprising at least about 90 to about 100 weight % polyester fiber having at least one mounting structure attached to or integrated into the display panel. The display panel can be adapted to be mounted onto a unitary folding supporting structure via the mounting structure. The mounting structure can be hook(s) or loop(s) of hook and loop fastener(s), buttonhole(s), loop(s) made of elastic material which is/are present in or attached to a hem of the display panel or one or more zippers. In the zipper embodiment at least part of the supporting structure is enveloped when the display panel is mounted onto the folding supporting structure via said zipper(s). The base portion and/or the body of the display panel can be substantially made of the stretch polyester fabric. The mounting structure may be attached to at least one main mounting support. The display panel can have one or more supplemental mounting supports, which are optionally connected to the main mounting support.

Advantages

When displays are used for in trade shows or temporary expositions, transportability of those displays is highly advantageous. In such a context it is also highly desirable, that a display can be set up quickly and easily.

Accordingly, in some embodiments, the display panels of the present invention are light weight.

In certain embodiments, the display panels can be folded into multiple directions. In some embodiments, the display panel can remain attached to a folding supporting structure during folding. In certain embodiments, the display panel can remain attached to a folding support structure when the supporting structure is folded and unfolded. In some embodiments, the display panel will be attachable and/or detachable from its supporting structure without breaking connections between portions of said supporting support. In certain embodiments, the display panel can be mounted directly to the supporting structure without the use of a separate mounting structure. In certain embodiments, the display panel can be attached and/or detached from the supporting structure by hand, that is without the use of any tool. In some embodiments, the display panel can be mounted onto and/or dismounted from a supporting structure by a single person within seconds. In some embodiments the display including display panels can be assembled and/or disassembled by a single person within a matter of seconds. In some embodiments, the display including display panels can be assembled and/or disassembled by a single person within a matter of a few minutes.

In many cases it is important that a display panel looks attractive after its set up and is safe.

Accordingly, in some embodiments, the display panels will be substantially wrinkle free within a short period after, either being mounted on a supporting structure, or after the supporting structure has been unfolded. Thus, such panels, even if they were folded into many different directions e.g. by being attached to a folded supporting structure or being stuffed into a small space, will have excellent appearance after being mounted for only a short period of time. In some embodiments, the surface of the body of a display panel will be, when mounted, substantially ripple free. In some embodiments, the color of the display panel will be substantially fade resistant. In some embodiments, the display panel will be fire resistant.

In many cases it is also important that display panels are not too costly and versatile. Thus, certain production features are advantageous.

In many embodiments, the display panel can be produced separately from the supporting structure. In some embodiments, the display panel can be specifically adapted to the design of the particular supporting structure.

All embodiments of the invention, whether specifically disclosed herein or not, will not necessarily have all of the above advantages, nor the same combinations of advantages. Moreover, users of the invention, manufacturers of components or complete panels according to the present invention and other persons skilled in the art may identify, with the aid of the present disclosure and/or through experience with the invention, embodiments that inherently include advantages not discussed above.

Definitions

"Polyester fiber" as used herein is a manufactured fiber in which the fiber forming substance is any long-chain synthetic polymer composed of at least 85% by weight of an ester of a substituted aromatic carboxylic acid, including, but not restricted to substituted terephthalic units and para-substituted hydroxy-benzoate units.

"Display panels" as used herein refers to any type of structure having at least one surface that is useful for displaying purposes. The display panels can carry indicia, information, designs etc.

"Stretch fabric" as used herein refers to any type of fabric that extends when placed under tension, at least in parts, beyond the limits it assumes when it is not placed under tension. The stretchable fabrics of the present invention have, to some extent and over some period time, elastic properties.

"Base portion" as used herein in connection with display panels refers to a portion that extends across a display panel and which may or may not carry secondary structures, such as appliques.

"Body" as used herein in connection with display panels refers to a structure that bears stretch loads within a display panel from a first mounting structure to a second mounting structure and that may extend across part or all of the space between the first and second mounting structures.

"Cornerless" as used herein in connection with display panels refers to display panels, that when not mounted, have no corners.

"Corner" as used herein refers to a point at the border of an area that renders the area to be not a circle or ellipse. Such corners take any shape and can be, e.g., pointed or rounded.

"Hem" as used herein refers to borders and edges.

"Part of a hem" as used herein refers to being integral or connected to the hem.

"Unitary folding supporting structure" as used herein refers to a folding supporting structure that is adapted to have a display panel directly or indirectly mounted thereon and which can, in normal use, be folded into or upon itself. The unitary folding supporting structure is only unitary insofar as it does not require another folding supporting structure to take part in the mounting of a display panel. The addition of accessory structures that, e.g., serve as interfaces between the unitary folding supporting structure and the display panel, such as mounting supports that facilitate mounting of displays, or accessory structures that do not directly take part in supporting a display panel, such as stands, will not negate that a particular folding supporting structure is unitary.

"Hook and loop fastener" as used herein refers to any fastener that uses hooks and loops for fastening purposes. Accordingly, a hook of a hook and loop fastener can be, e.g., a simple metal or plastic hook, or a hook portion of a hook and loop fabric fastener, such as that sold under the trademark VELCRO.

VARIOUS AND PREFERRED EMBODIMENTS

Figure 1:
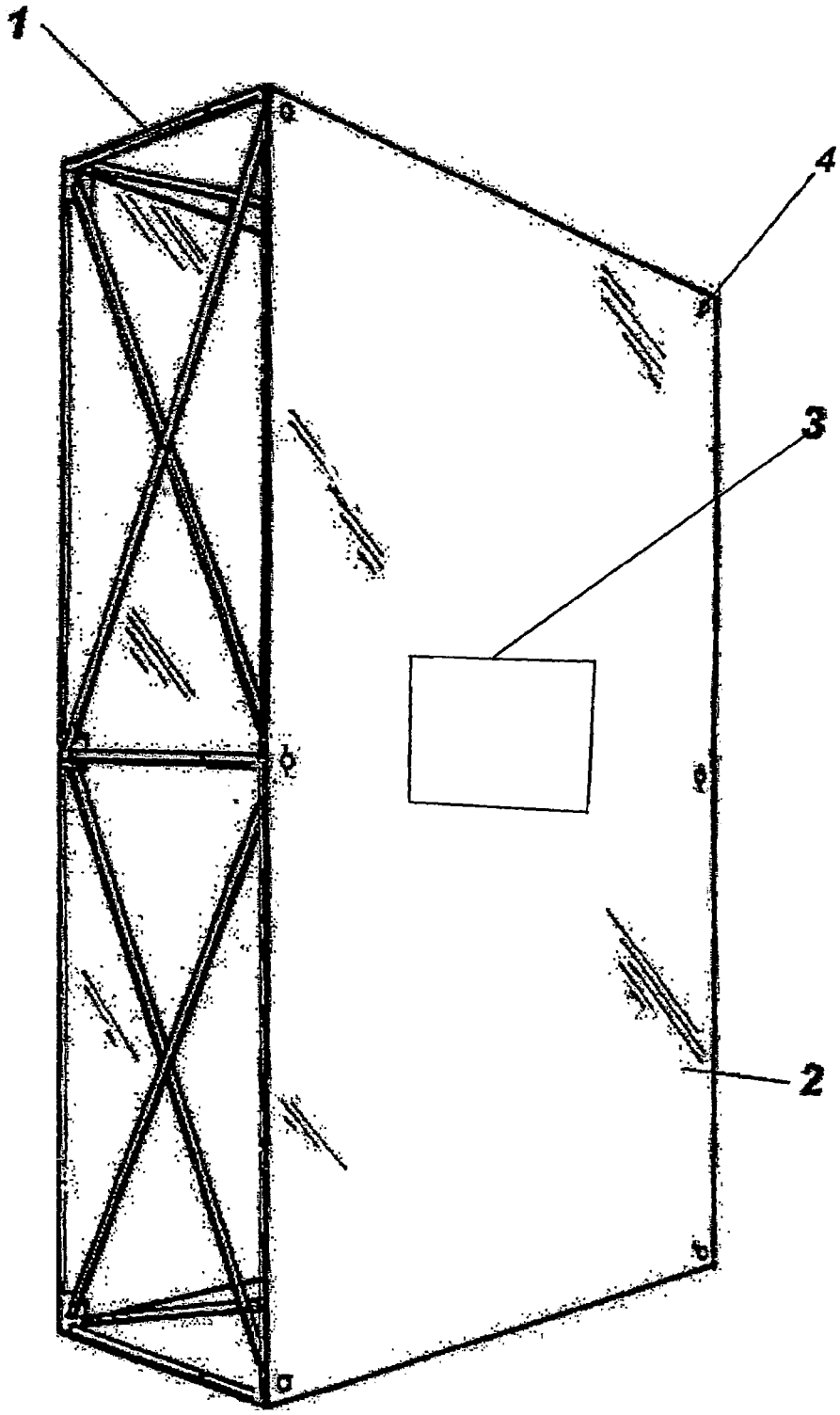
FIG. 1 is a perspective view of a support frame with stretch panels attached to it.

The present invention is directed to display panels that are adapted to be mounted on supporting structures.

At least portions of the display panels of the present invention are made of stretch fabric. In a preferred embodiment, this stretch fabric is a single layer fabric and in some embodiments, the stretch fabric is a single thickness fabric. In some embodiments, only the body of the panel will be stretch fabric, other portions of the panel are made of any type of material that is suitable for the purpose of the display, such as, but not limited to, fabrics such as natural fiber fabrics; e.g. cotton; synthetic fabrics, e.g., polyester based non-stretch fabrics, acetate/rayon mix fabrics, nylon fabrics; semisynthetic fabrics; fabrics with a metallic component; fiberglass based fabrics; cellulose/fiberglass mix materials; cellulose based materials; or plastic materials such as PVC or combinations thereof. In some embodiments, the base portion of the display panel is made of stretch fabric. In some embodiments, the entire display panel is made of stretch fabric.

The stretch fabric of the present invention is in many embodiments made of polyester fiber that comprises about 90 to about 100% polyester. Some of these fabrics contain up to about 10% Lycra. In some embodiments, the fabric is single layer stretch fabric. In some embodiments, the fabric is a single thickness of fabric. Fabric such a brocade are considered to be a single thickness of fabric. In some of the embodiments, the fabric is flame resistant or, more preferably, permanently flame resistant. In some embodiments, the fabric is a two-way stretch fabric, with a stretch of, for example, 10%×10%, 20%×20%, 30%×30%, 40%×40% or 50%×50%. In some embodiments, the fabric is a multiple ways stretch fabric. In some embodiments, the fabric has a flat weave with only slight stretch. While many of the stretch fabrics of the present invention are classified as "middle weight" and "heavy weight" fabrics, they are very lightweight compared to other materials that display panels are often made of, such as cardboard paper and plastic sheet materials. Some of the fabrics weigh less than 10 ounces per square yard, more preferably less than 6 ounces per square yard or less than 5 ounces per square yard. Stretch fabrics that have been found to be advantageous are marketed under the trademarks ACROBAT, TRAPESE, CELTIC CLOTH and POWER NET 100. However, other polyester stretch fabrics are within the scope of the present invention. Stretch fabrics that do not contain any polyester or minor amounts of polyester are also within the scope of the present invention. In many embodiments, the stretch fabric has been subjected to printing. In some embodiments, matter has been printed onto the stretch fabric via digital printing, for example via printing on VUTEX, NUR, SALSA and SCITEX digital print systems. In some embodiments, matter has been printed onto the fabric by silk screening. In certain embodiments, matter has been printed onto the fabric by ink jet printing. In a preferred embodiment, matter has been printed onto the stretch fabric via dye sublimation. However, any suitable method to apply printed material onto the stretch fabric is within the scope of the invention.

The display panels of the present invention are adapted to be mounted on supporting structures. A wide variety of supporting structures are contemplated. Essentially any supporting structure to which the display panel described herein can be mounted, either with or without prior modification of the support structure or with or without the use of mounting accessories, such as mounting bars, is within the scope of the present invention. In a preferred embodiment, such supporting structures are foldable frames. In a more preferred embodiment, such foldable frames are lightweight. In another preferred embodiment, such frames can be brought into a compact state within a very short time. In another preferred embodiment, the supporting structure has integral hubs onto which the display panels can be mounted via e.g. buttonholes or loop structures. Suitable foldable frames are described in U.S. Pat. Nos. 4,986,016 and 5,125,205. When a display panel according of the present invention is mounted onto a fully set up supporting structure, the stretch fabric of the display panel is, in most embodiments, under stretch tension.

Some preferred ways of mounting the display panels of the present invention onto such supporting structures will now be described with reference to the figures.

FIG. 1 shows a display panel 2 according to the present invention mounted onto a supporting structure 1. Material 3 is printed on the display panel. In some embodiments, a base portion of the display panel is made of stretch fabric and material is directly printed onto this base portion. In other embodiments structures, such as appliques or pouches, are attached to the base portion of the display panel. In such embodiments, the base portion may or may not have printed material on it. In some embodiments, the body of the display panel is made of stretch fabric, while the remainder of the display panel is made of other materials. Some suitable materials that can be used in such a display panel have been described above. In some embodiments, at least parts of the stretch fabric are of single layer construction. As indicated above, when a display panel 2 is attached to a fully set up support structure, at least the body of the display panel is, in a preferred embodiment, under stretch tension. This, in combination with a preferred mounting of the panel, which will be described in more detail below, allows, in certain preferred embodiments, for a mostly ripple free appearance of those portions of the display panel that are made of stretch fabric. A panel mounted in the way shown in FIG. 1 will generally be wrinkle free after the display panel has been mounted for only a short period of time on a supporting structure even if the display panel was folded into different directions prior to mounting.

The periphery of the display panels are, in certain, but not all, preferred embodiments, made of stretch fabric. In this and other embodiment, the edges of the display panel may have a hem that is made by turning and sewing the borders of at least parts of the panel. However, as the person skilled in the art will appreciate, any other suitable hem is within the scope of the invention.

The display panel according to a present invention can be mounted onto a supporting structure in many different ways.

Figure 2A:
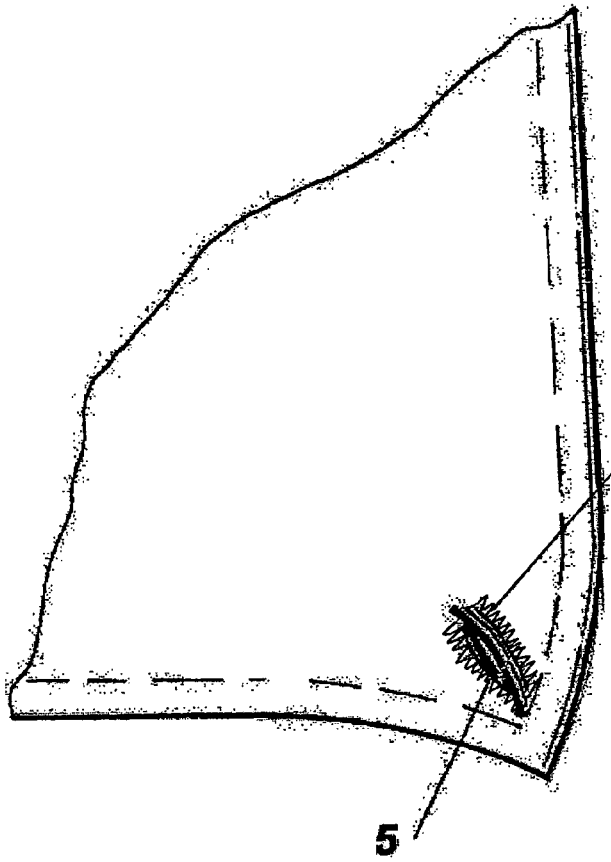
FIG. 2*a* shows a display panel with a corner buttonhole (with stitched reinforcement at the edges) that is adapted to be attached to a hub of a supporting structure.
Figure 2B:
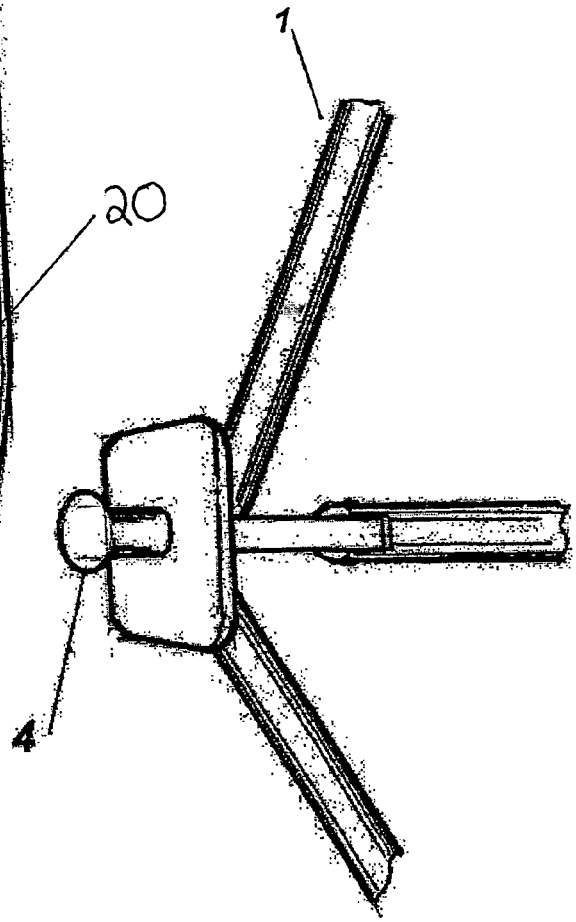
FIG. 2*b* shows a hub of a supporting structure.
Figure 3A:
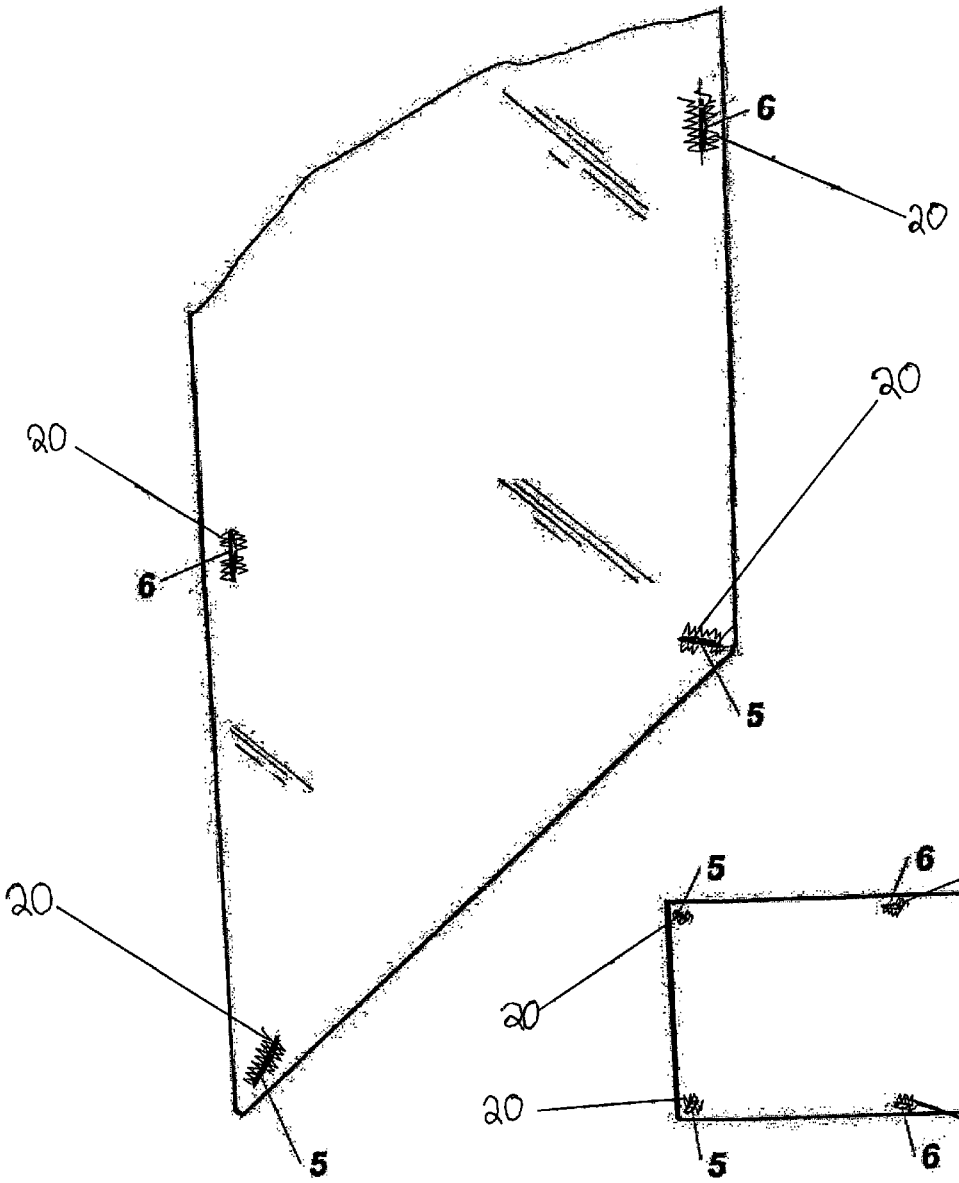
FIG. 3*a* is a perspective view and FIG. 3*b* is a top view of a display panel that has buttonholes (with stitched reinforcement at the edges) aligned in different angular orientations.
Figure 3B:
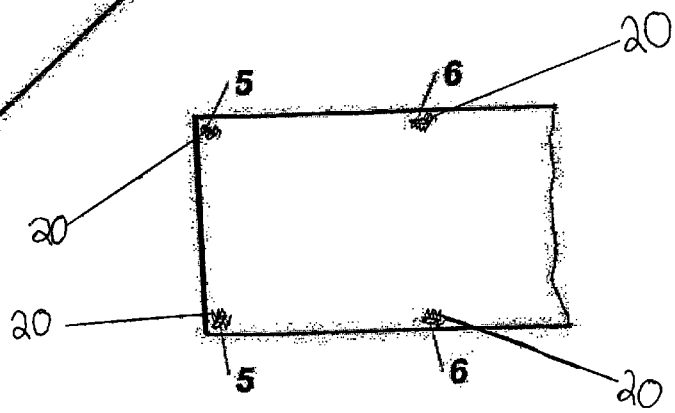

In one preferred embodiment, the display panel has apertures that can be fastened to protrusions that are part of the supporting structure such as the hubs 4 shown in FIGS. 1 and 2*a, b*. While in some preferred embodiments, those protrusions are part of the supporting structure, in other preferred embodiments, suitable protrusions can be attached to the supporting structure. Any protrusion that allows fastening of the display panel via an aperture to the supporting structure is suitable. In one preferred embodiment, the apertures in the display panel are buttonholes. In an even more preferred embodiment these buttonholes are elongated. In yet another preferred embodiment, the buttonholes have reinforcement at their edges. In the embodiment shown in FIG. 2*a, b* and 3*a, b*, the display panels have corners of roughly 90° and the longitudinal axis of the buttonholes 5 locates in such corners divide these corners into roughly equal parts. However, the corners of the present invention can have many different angles, may or may not be pointed and may or may not be defined by substantially straight sides. For example, rounded corners and corners defined by undulating or rounded sides are within the scope of the claimed invention. Equally, the alignment of the buttonholes can take many different directions. In embodiments in which there are at least two pairs of diagonally opposed elongated buttonholes, one can imagine a first axis defined by an imaginary reference line passing through a first of said pairs and a central portion of a display panel and a second axis defined by a second imaginary reference line passing through the second of said pairs of buttonholes and a central portion of the display panel. In such embodiments, the first and second buttonhole pairs may take any direction in which they are elongated more nearly parallel then perpendicular to said first and second axes. In a preferred embodiment, these first and second buttonhole pairs are substantially parallel to said first and second axes. Buttonholes with this orientation are designated 5 in FIGS. 2*a, b* and 3*a, b*. As depicted in FIG. 3*a* and FIG. 3*b*, additional buttonholes 6 may have different orientation. Those additional buttonholes are more nearly parallel than perpendicular to an imaginary reference line extending along a side of the display panel. In many embodiments, and as shown in FIGS. 2*a, b* and 3*a, b*, the buttonholes are at the edge of the display panel. However, the buttonholes can be at any other suitable position. At least some of the buttonholes are, in certain embodiments, in single layer portions of the stretch fabric. Additionally, in some embodiments, the buttonholes have stitched reinforcement 20 at the edges.

Figure 4A:
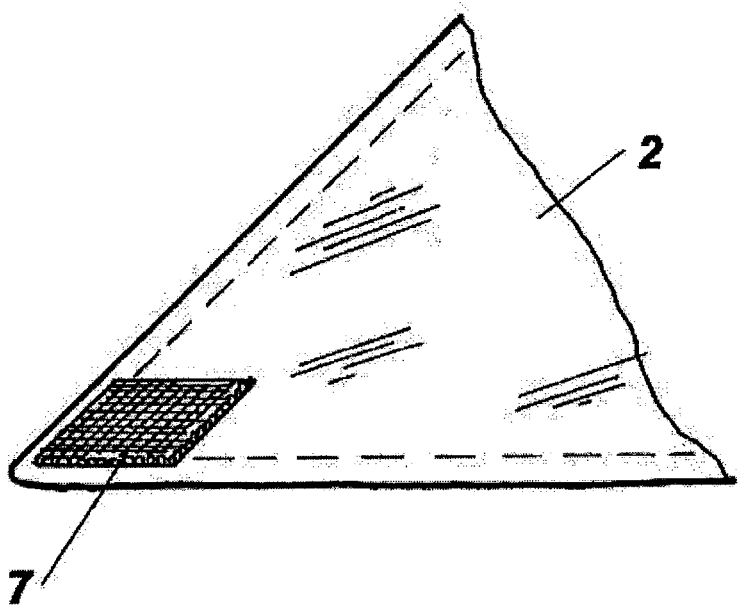
FIGS. 4*a* and 4*b* are back and front views, respectively, of parts of a display panel having a VELCRO mounting attachment.
Figure 4B:
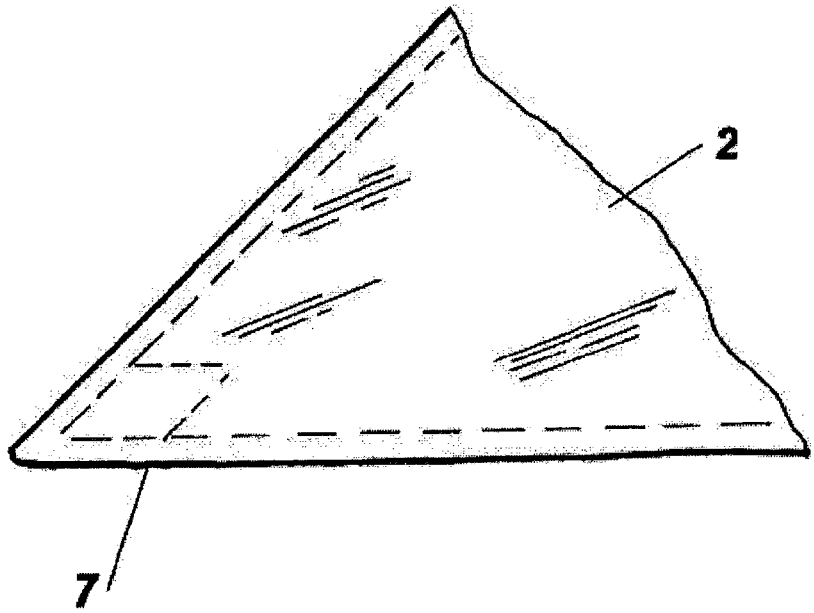

Another embodiment includes fastening the display panels to a supporting structure via one or more VELCRO fasteners. FIGS. 4*a* and 4*b* shows how, for example, one part of a VELCRO fastener 7 can be attached to a display panel. In the embodiment shown, the display panel would be attached via a complimentary part of the VELCRO fastener which is attached or part of the supporting structure. Many modifications of the arrangement shown are within the scope of the present invention. The VELCRO fastener can take different shapes and positions. For example, the VELCRO fastener can be attached to the display panel along an edge of the panel and, if desirable, the center as well as any portion of the panel between the center and the edges. Also, the complimentary part of the VELCRO fastener can be attached to the display panel itself. In such an embodiment, fastening can be achieved, e.g., by wrapping parts of the panel around the supporting structure and securing the complimentary parts of the VELCRO fastener to each other.

Figure 5A:
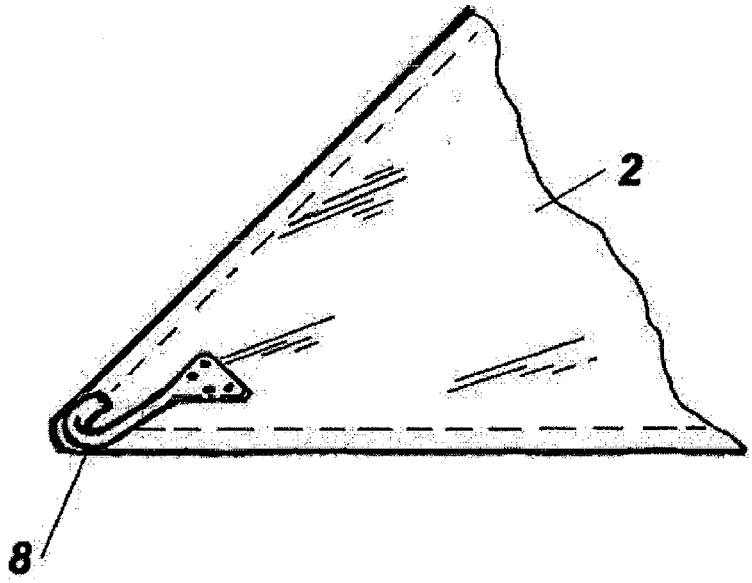
FIGS. 5*a* and 5*b* are back and front views, respectively, of parts of a display panel having a hook mounting attachment.
Figure 5B:
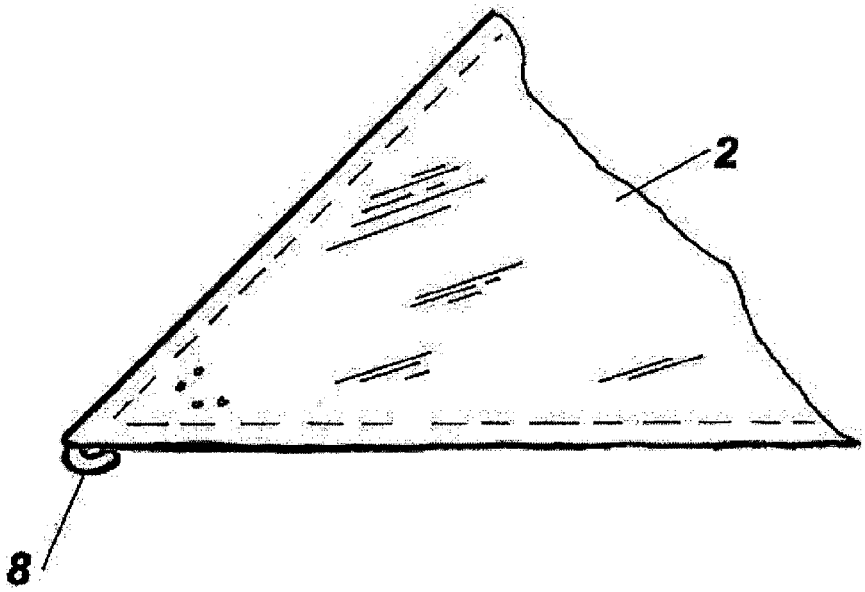
Figure 6A:
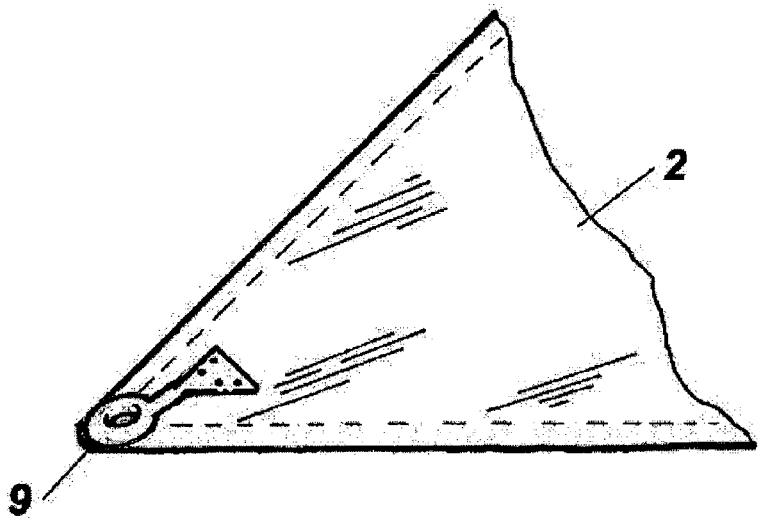
FIGS. 6*a* and 6*b* are back and front views, respectively, of parts of a display panel with a loop mounting attachment.
Figure 6B:
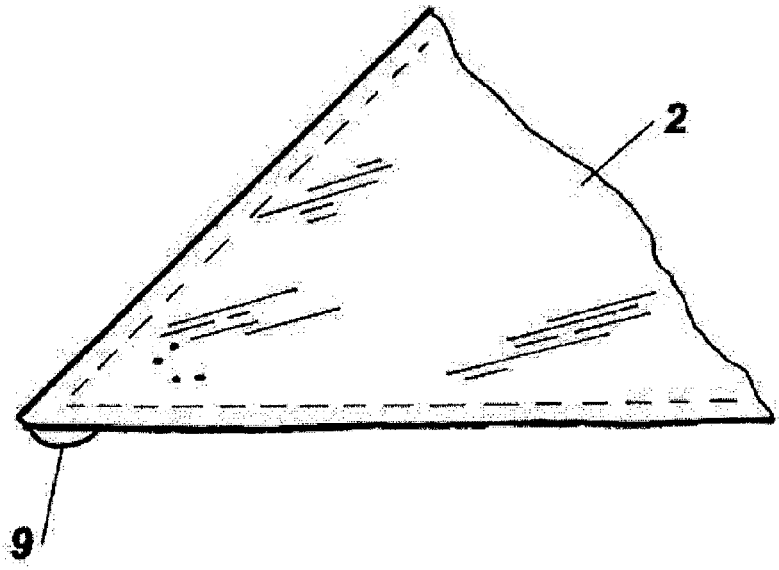

Another contemplated embodiment of the present invention includes fastening the display panels to a supporting structure via hook(s) and/or loop(s) that are attached to the display panel. FIGS. 5*a* and 5*b* shows how a hook 8 can be attached to a display panel and FIGS. 6*a* and 6*b* shows how a loop 9 can be attached to a display panel. In these embodiments, the display panel can be attached to any part of the supporting structure to which a hook or loop, respectively, can be fastened. Alternatively, loop(s) and hook(s) complimentary to the hook(s) and/or loop(s) of the display panel can be attached to or be part of the supporting structure. In one embodiment, a display panel includes both hooks and loops. Many modifications of the configurations shown in FIGS. 5*a, b* and 6*a, b* are contemplated. The hooks and loops can take any form and size that allows attachment to a respective supporting structure. The hooks and loops can be made of any suitable material, e.g. plastic, metal or fabric. The hooks and loops can also be attached to the display panel at different places including the edges of the panel and, if desirable, the center as well as any portion of the panel between the center and the edges. The hooks and loops can take any form and size that allows attachment to a respective supporting structure. The supporting structure may or may not have complementary loops and hooks.

Figure 7A:
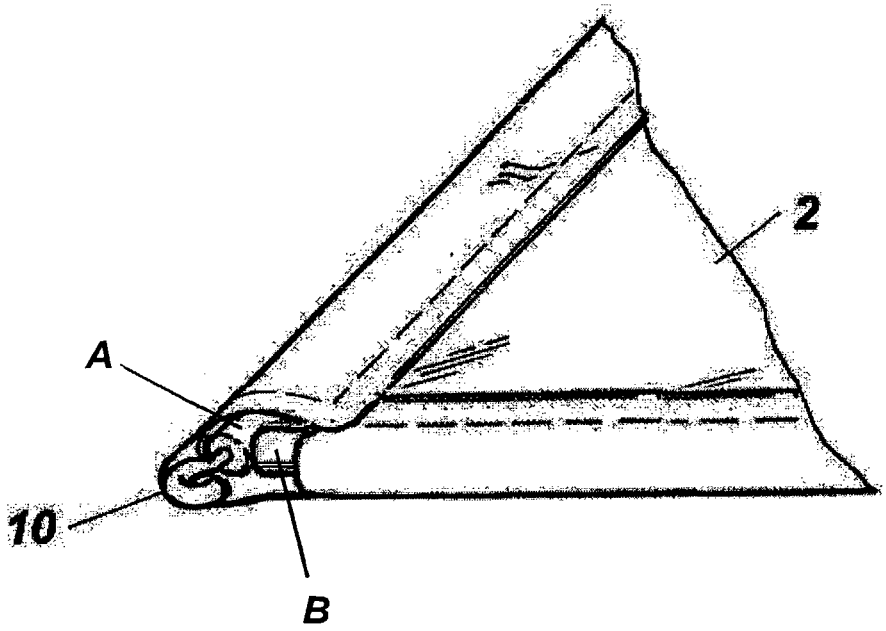
FIGS. 7*a* and 7*b* show parts of a display panel with a mounting attachment in form of a hook attached to a rod integrated into the hem of the panel, an additional or integral rod is also shown.
Figure 7B:
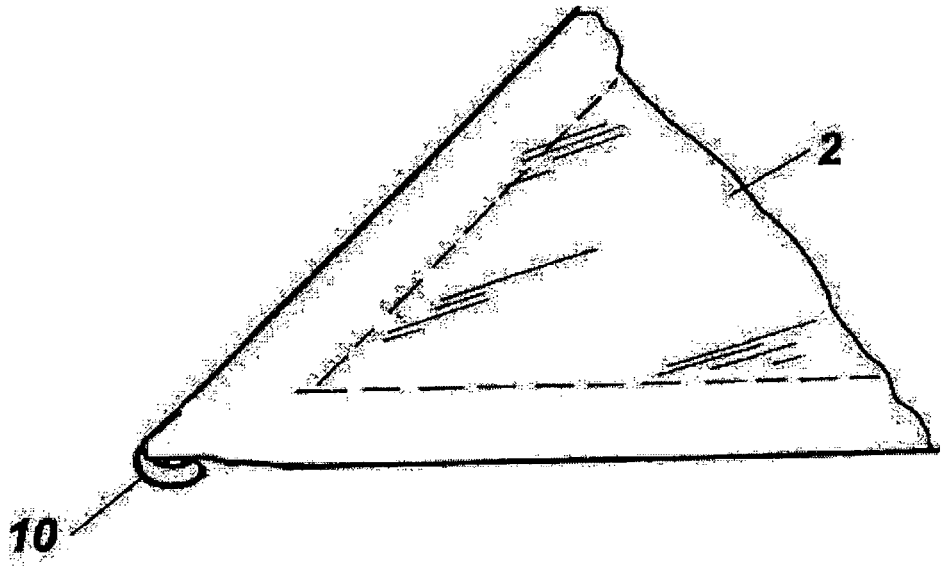
Figure 8A:
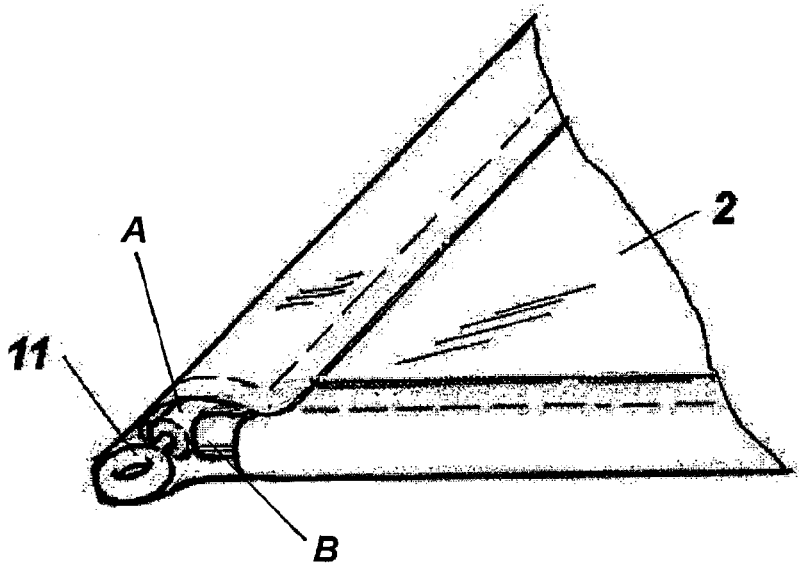
FIGS. 8*a* and 8*b* show parts of a display panel with a mounting attachment in form of a loop attached to a rod.
Figure 8B:
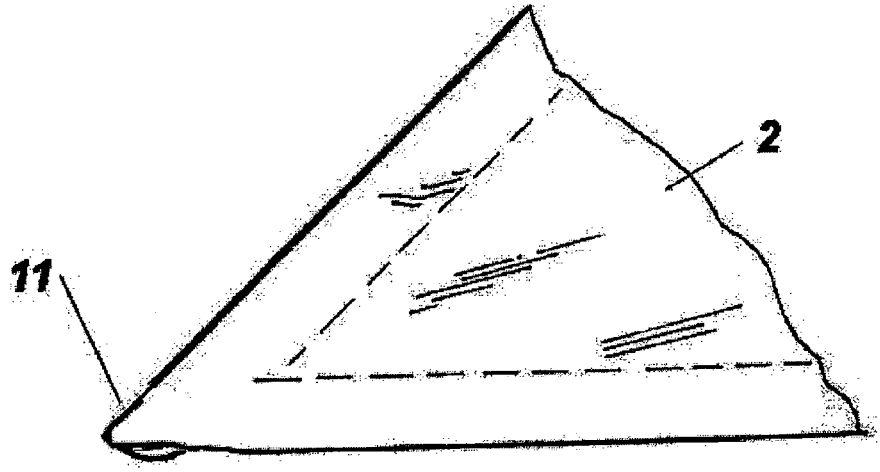

Another contemplated embodiment includes fastening the display panels to a supporting structure via mounting structures such as hook(s) and loop(s) that is/are attached to one or more mounting supports such as a rod. FIGS. 7*a* and 7*b* shows a mounting structure in form of a hook 10 attached to a mounting support, e.g., a rod A, that is sewn into a hem of the display panel 2. FIGS. 7*a* and 7*b* show a rod B that is sewn into the hem and is attached to rod A. In some embodiments, rod B or a similar mounting support, will be a integral part of rod A. FIGS. 8*a* and 8*b* shows a loop 11 attached to a mounting support, e.g., a rod, that is sewn into a hem of the display panel 2. The mounting supports can take different shapes, can be made from different materials and can be attached to the panel in any suitable way. While FIGS. 7*a, b* and 8*a, b* show hooks and loops as distinct entities of the mounting structure, integral hooks and loops or any other integral mounting structure such the mounting structures discussed above, as well as structures that are part of the mounting support and that fulfil mounting structure functions are within the scope of the present invention. Again many modifications of the configurations shown in FIGS. 7*a, b* and 8*a, b* are contemplated. The mounting support can be attached to a display panel at different places including the edges of a panel and, if desirable, a central portion of the display panel as well as any portion of the panel between the center and the edges. The mounting structures can be at any suitable place on the mounting support.

Figure 9A:
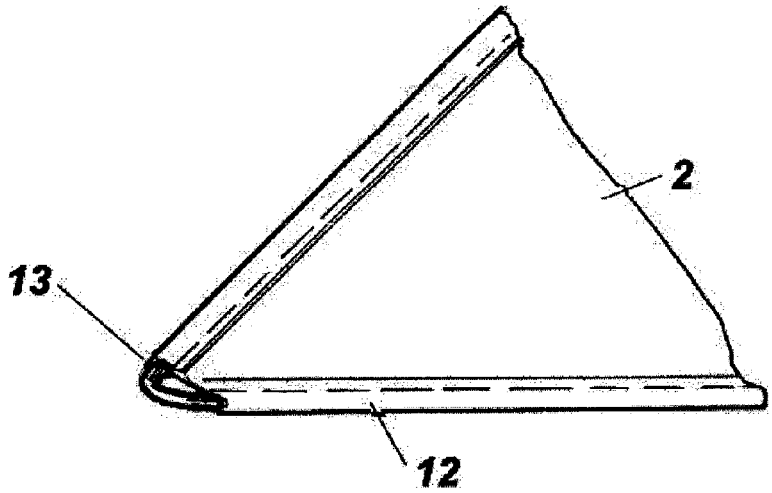
FIGS. 9*a*–9*d* show display panels with different elastic loop mounting attachments.
Figure 9B:
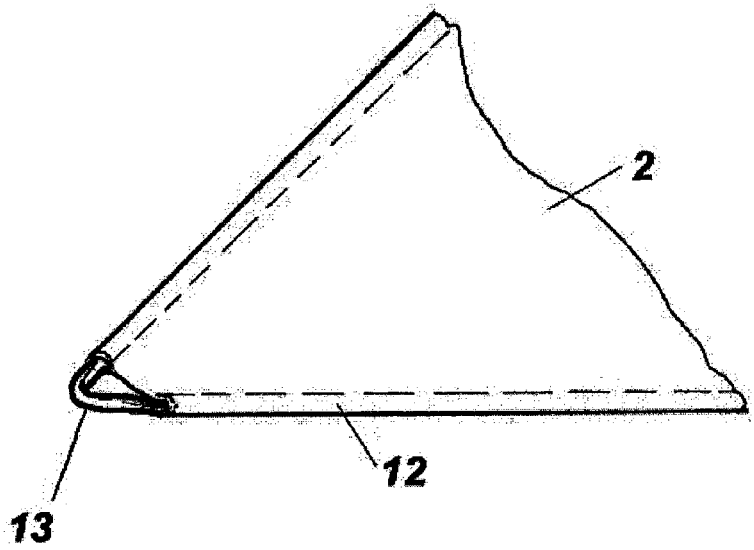
Figure 9C:
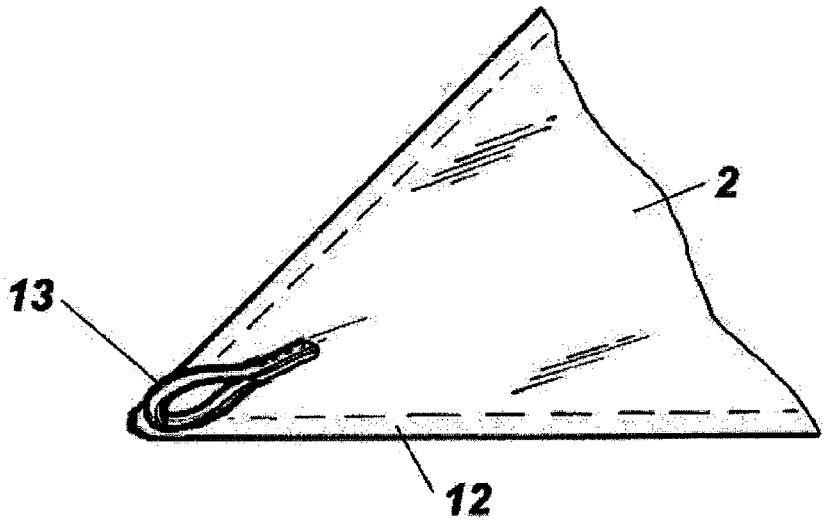
Figure 9D:
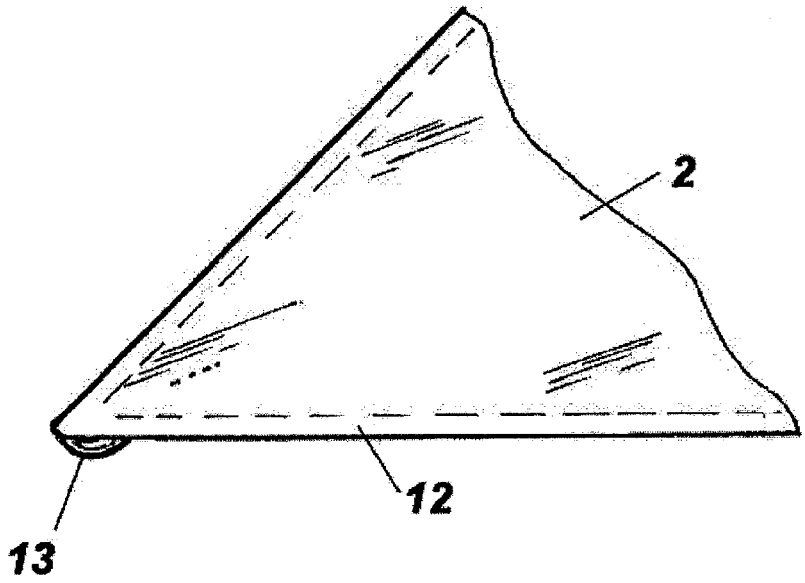

Another embodiment includes fastening the display panels to a supporting structure via elastic loop structures that are attached to the display panel. FIGS. 9*a* and 9*b* show two of many different ways in which an elastic loop 13 can be attached to an display panel. FIG. 9*a* shows an elastic loop that forms an integral part of the hem of the display panel. FIG. 9*b* shows an elastic loop that is attached to a corner of the display panel. In a preferred embodiment, the elastic loop(s) are/is attached to the hem of the display panel. In another preferred embodiment, the elastic loop(s) are/is an integral part of the hem of the display panel. Additional elastic loops can be attached at any other part of the display panel. The loop(s) only have to have minimal elasticity and are not restricted to any particular material.

Figure 10:
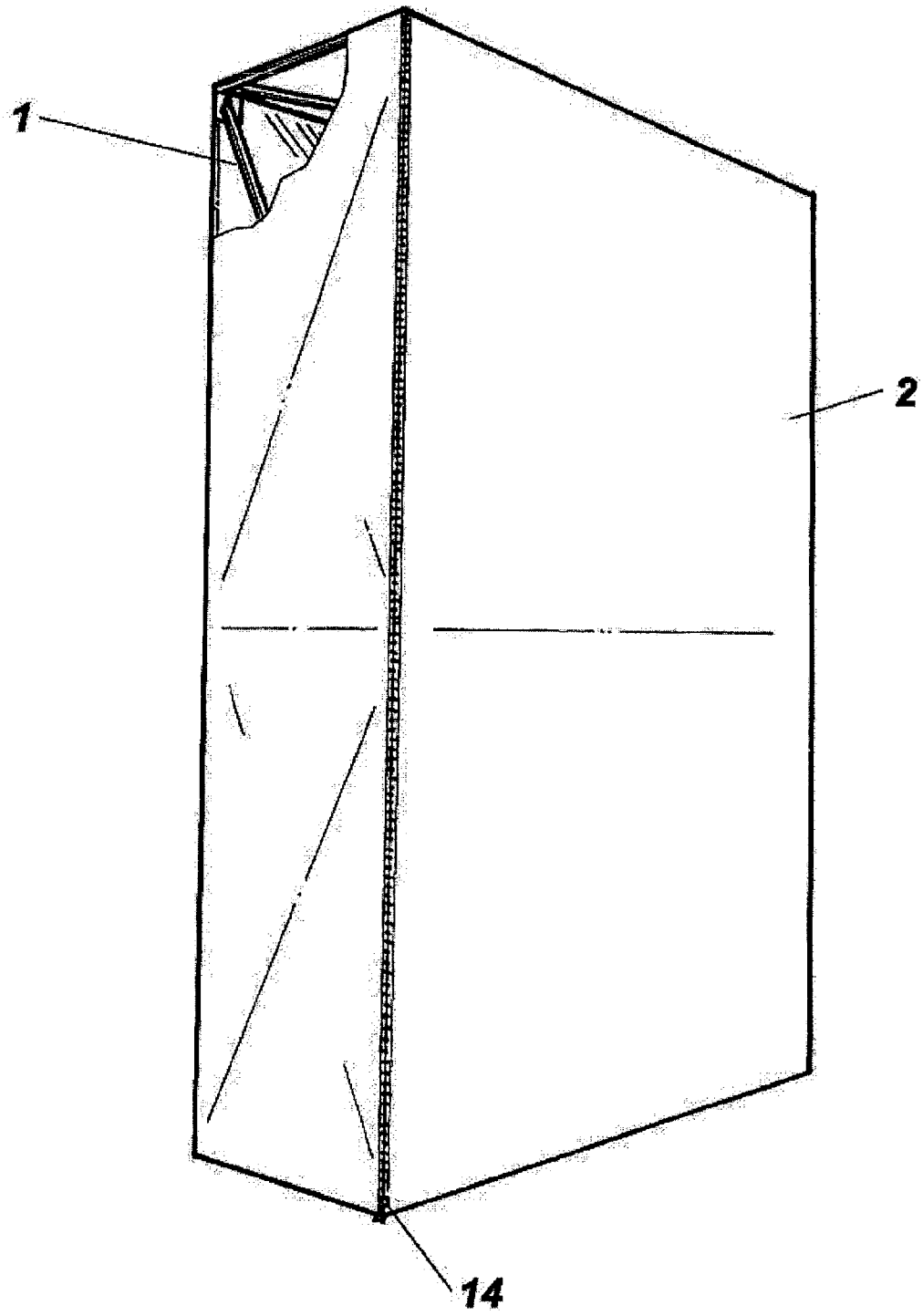
FIG. 10 shows part of a display panel which is mounted over a supporting structure. The display panel is mounted on the supporting structure via a zipper arrangement.

Another embodiment includes fastening the display panels to a supporting structure via a zipper. FIG. 10 shows a display panel that envelops a supporting structure whereby envelopment of the supporting structure 1 is achieved via a zipper 14 that connects edges of the display panel. While FIG. 10 shows a configuration in which the entire supporting structure is enveloped, partial enveloping of a supporting structure is within the scope of the present invention. One or more zippers are contemplated. The zippers can be aligned with the support structure as shown in the drawings, but can, depending on the shape of the display panel(s) be aligned in any other suitable way. In connection with this zipper configuration, a singular display panel can be zipped up around the supporting structure or multiple display panels can be zipped together. Also, one or more display panel attached to one or more other panels, such as stretch or non-stretch cloth panels, via one or more zippers.

Figure 11:
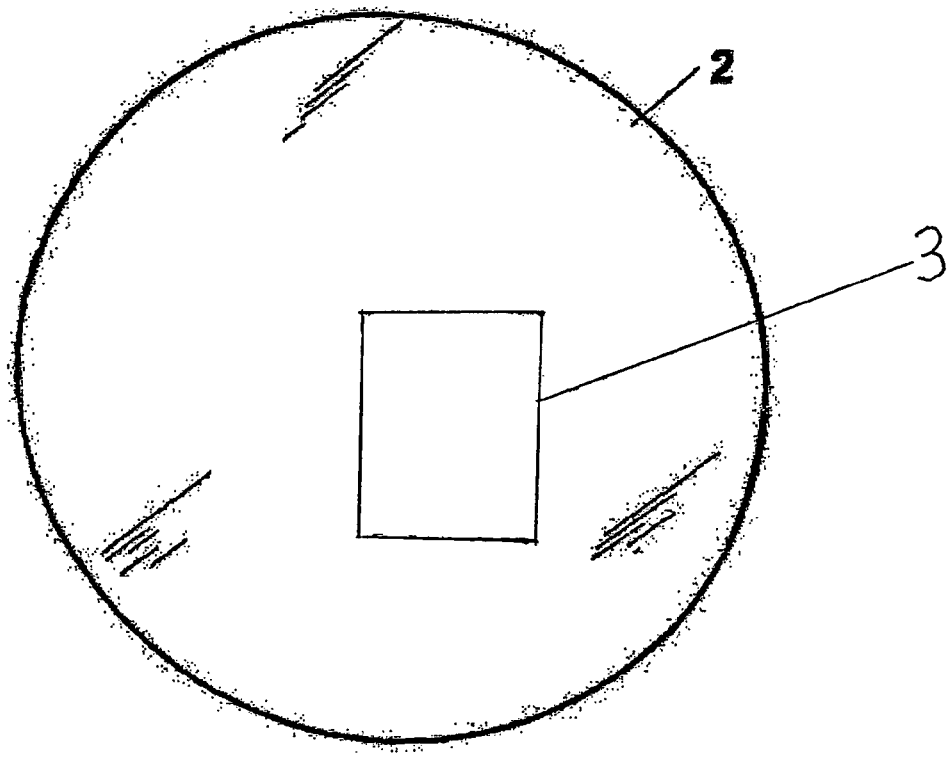
FIG. 11 shows a round display panel.
Figure 12:
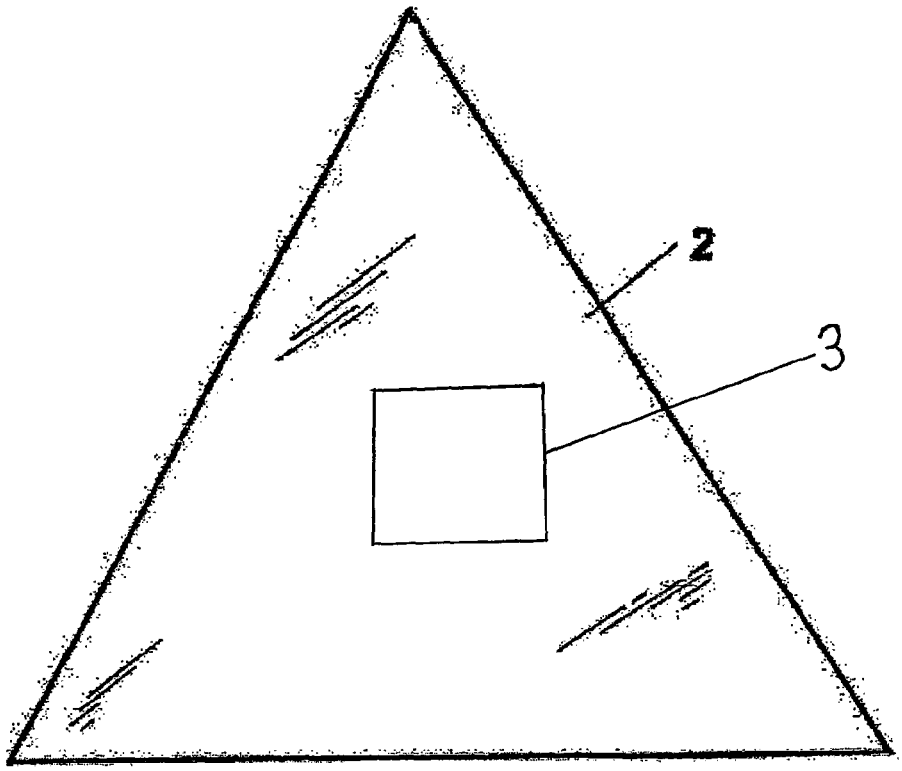
FIG. 12 shows a triangular display panel.

FIGS. 11 and 12 show some representative configurations of the display panel according to the present invention. FIG. 11 shows a round panel and FIG. 12 shows a triangular panel. However, any desirable configuration of the display panel is within the scope of the invention.

While different types of arrangements to fasten a display panel according to the present invention to a supporting structure have been disclosed, it will be clear to the person skilled in the art that any suitable combination of the different fastening arrangements discussed herein are within the scope of the present invention.

While particular embodiments of the invention have been shown and described, and a number of different modifications and alternatives have been presented, it will be obvious to those skilled in the art from the present disclosure that changes and further modifications may be made without departing from the invention. The appended claims should be construed to cover those changes and further modifications.

I claim:

1. A display apparatus comprising:

a foldable frame having a plurality of display panel connectors; said foldable frame being foldable for transport and unfoldable for assembly to at least one display panel for erection as said display apparatus;

said at least one display panel comprising, at least in part, a layer of stretchable fabric, said display panel including a plurality of apertures for removably connecting to said plurality of display panel connectors, said plurality of apertures being located spaced apart from one another proximal a perimeter of said display panel, each of said plurality of apertures being so configured as generally elongated in shape and oriented in a particular angular orientation such that when said display panel is stretched and connected to said frame by affixing said plurality of apertures to said plurality of display panel connectors, said display panel appears substantially wrinkle free, wherein, in a final assembled state as said display apparatus, said display panel is capable of being readily user-removed from said frame for de-assembling said display apparatus and folding said frame for transport;

wherein said display panel is generally rectangular in configuration and includes a top edge including two corners and a bottom edge including two corners, and wherein each said corner of said top and bottom edges includes one of said plurality of apertures located proximal thereto;

wherein each of said plurality of apertures includes an axis extending longitudinally through the length thereof; and wherein said axes of said apertures located proximal said corners of said top edge are oriented at a substantially different angular orientation than said axes of said apertures located proximal said corners of said bottom edge;

wherein said display panel has a perimeter comprised of two vertical sides joined to two horizontal sides, and wherein said axes of two apertures located non-diagonally, adjacent one another are oriented substantially parallel to one of said vertical or said horizontal sides; and wherein said axes of two different apertures located non-diagonally adjacent one another are oriented to a large extent non-parallel to both said vertical and said horizontal sides.

2. A display apparatus according to claim 1, wherein said axes of two of said apertures located non-diagonally adjacent one another are oriented at approximately a 45 degree angle relative to both said vertical and said horizontal sides.

3. A display apparatus according to claim 2, wherein said plurality of apertures comprise eyelets of elastic material integrated into a hem of said display panel.

4. A display apparatus according to claim 1, wherein at least a base portion of said display panel is comprised of single layer stretch fabric.

5. A display apparatus according to claim 4, wherein said stretch fabric weighs less than 10 ounces per square yard.

6. A display apparatus according to claim 1, wherein said display panel is adapted to be mounted on a folding frame and is adapted to stay attached to said folding frame when said folding frame is folded.

7. A display apparatus according to claim 1, wherein said display panel comprises:

a stretch polyester fabric comprising at least about 90 to about 100 weight % polyester fiber.

8. A display apparatus according to claim 1, wherein a longitudinal axis of at least two of said plurality of apertures, each one of said at least two of said plurality of apertures located in one of said plurality of corners, divides each of said corners into two substantially equal sections.

9. A display apparatus according to claim 1 wherein said frame comprises a plurality of rods and includes at least one breakable connection in the structure thereof for enabling folding of said frame for transport.

10. A display apparatus according to claim 9 wherein said frame is foldable upon itself into a reduced size configuration.

11. A display apparatus according to claim 1 wherein said frame comprises a plurality of rods and is foldable upon itself into a reduced size configuration.

12. A display apparatus comprising;

a frame having a plurality of display panel connectors;

at least one display panel having a perimeter comprised of two generally vertical sides joined to two generally horizontal sides, said at least one display panel comprising, at least in part, a layer of stretchable fabric; said display panel including at least four elongated apertures each having a longitudinal axis extending through the elongated portion thereof, said at least four elongated apertures being configured for removably connecting to said plurality of display panel connectors, said at least four elongated apertures being located spaced apart from one another proximal said perimeter of said display panel; and wherein two of said at least four elongated apertures are oriented such that their said longitudinal axes are substantially parallel to one of said horizontal and said vertical sides, and wherein the remaining two of said at least four elongated apertures are oriented such that their said longitudinal axes are oriented at approximately a 45 degree angle relative to both said vertical and said horizontal sides; and wherein when said display panel is removably connected to said frame by removably affixing said at least four elongated apertures to said plurality of display panel connectors, said orientations of said at least four elongated apertures, in combination, cause said display panel to have a substantially wrinkle free appearance.

13. A display apparatus according to claim 12 wherein said two of said at least four elongated apertures oriented substantially parallel to one of said horizontal and said vertical sides are located non-diagonally adjacent one another in respective first and second corners of said display panel; and wherein said two of said at least four elongated apertures oriented such that their said longitudinal axes are oriented at approximately a 45 degree angle relative to both said vertical and said horizontal sides are located non-diagonally adjacent one another in respective third and fourth corners of said display panel.

14. A display apparatus according to claim 13 wherein said frame is foldable for transport and unfoldable for assembly to at least one display panel for erection as said display apparatus; and wherein, in a final assembled state as said display apparatus, said display panel is capable of being readily user-removed from said frame for de-assembling said display apparatus and folding said frame for transport.

15. A display apparatus according to claim 14 wherein said plurality of apertures comprise eyelets of elastic material integrated into a hem of said display panel.

16. A display apparatus comprising:

a foldable frame having a plurality of display panel connectors; said foldable frame being foldable for transport and unfoldable for assembly to at least one display panel for erection as said display apparatus;

said at least one display panel comprising, at least in part, a layer of stretchable fabric, said display panel including a plurality of apertures for removably connecting to said plurality of display panel connectors, said plurality of apertures being located spaced apart from one another proximal a perimeter of said display panel, each of said plurality of apertures being so configured and oriented such that when said display panel is stretched and connected to said frame by affixing said plurality of apertures to said plurality of display panel connectors, said display panel appears substantially wrinkle free;

wherein said display panel includes at least four elongated apertures each having a longitudinal axis extending through the elongated portion thereof, said at least four elongated apertures being configured for removably connecting to said plurality of display panel connectors, said at least four elongated apertures being located spaced apart from one another proximal said perimeter of said display panel;

wherein two of said at least four elongated apertures are oriented such that their said longitudinal axes are substantially parallel to one of said horizontal and said vertical sides, and wherein the remaining two of said at least four elongated apertures are oriented such that their said longitudinal axes are oriented at approximately a 45 degree angle relative to both said vertical and said horizontal sides;

wherein when said display panel is removably connected to said frame by removably affixing said plurality of apertures to said plurality of display panel connectors, said orientations of said at least four elongated apertures, in combination, cause said display panel to have a substantially wrinkle free appearance;

wherein, in a final assembled state as said display apparatus, said display panel is capable of being readily user-removed from said frame for de-assembling said display apparatus and folding said frame for transport; and wherein, in said final assembled state, said display apparatus has a configuration non-suitable for seating use.

17. A display apparatus according to claim 16 wherein said two of said at least four elongated apertures oriented substantially parallel to one of said horizontal and said vertical sides are located non-diagonally adjacent one another in respective first and second corners of said display panel; and wherein said two of said at least four elongated apertures oriented such that their said longitudinal axes are oriented at approximately a 45 degree angle relative to both said vertical and said horizontal sides are located non-diagonally adjacent one another in respective third and fourth corners of said display panel.

18. A display apparatus according to claim 17 wherein said frame comprises a plurality of rods and includes at least one breakable connection in the structure thereof for enabling folding of said frame for transport.

19. A display apparatus according to claim 17 wherein said frame is foldable upon itself into a reduced size configuration.

20. A display apparatus according to claim 16 wherein said frame comprises a plurality of rods and is foldable upon itself into a reduced size configuration.

* * * * *